US010683112B2

(12) United States Patent
Forte

(10) Patent No.: US 10,683,112 B2
(45) Date of Patent: Jun. 16, 2020

(54) APPARATUS FOR CLOSING A FLUID CONTAINER

(71) Applicant: NEVIOT NATURE OF GALILEE LTD., Lod (IL)

(72) Inventor: Yehuda Forte, Yavne (IL)

(73) Assignee: NEVIOT NATURE OF GALILEE LTD., Lod (IL)

( * ) Notice: Subject to any disclaimer, the term of this patent is extended or adjusted under 35 U.S.C. 154(b) by 183 days.

(21) Appl. No.: 15/101,054

(22) PCT Filed: Dec. 10, 2014

(86) PCT No.: PCT/IL2014/051078
§ 371 (c)(1),
(2) Date: Jun. 2, 2016

(87) PCT Pub. No.: WO2015/087325
PCT Pub. Date: Jun. 18, 2015

(65) Prior Publication Data

US 2018/0170592 A1 Jun. 21, 2018

(30) Foreign Application Priority Data

Dec. 11, 2013 (IL) ..... 229909

(51) Int. Cl.
*B65B 7/28* (2006.01)
*B65B 69/00* (2006.01)
(Continued)

(52) U.S. Cl.
CPC ..... *B65B 7/285* (2013.01); *B65B 69/00* (2013.01); *B65D 47/2031* (2013.01);
(Continued)

(58) Field of Classification Search
CPC ..... B65B 7/285; B65B 69/00; B65D 47/2031; B65D 51/20; B65D 77/067;
(Continued)

(56) References Cited

U.S. PATENT DOCUMENTS 4,375,864 A * 3/1983 Savage ..... B65D 77/067 222/81
4,378,864 A * 4/1983 Stjarne ..... F16D 65/02 188/153 R
(Continued)

FOREIGN PATENT DOCUMENTS

CN 101512210 A 8/2009
DE 102008016449 A1 10/2008
(Continued)

*Primary Examiner* — Paul R Durand
*Assistant Examiner* — Andrew P Bainbridge
(74) *Attorney, Agent, or Firm* — Soroker Agmon Nordman

(57) ABSTRACT

The subject matter discloses a capping apparatus comprising: a top plate connected to a fluid container, said top plate comprises an apparatus opening through which fluid is dispersed from the fluid container; wherein the apparatus opening is defined by an opening wall; a rigid cork that is slide-ably moveable between a first state in which a cork is snapped into the apparatus opening and a second state where the cork is snapped out of the apparatus opening, wherein the cork moves between the first state and the second state in a horizontal direction.

18 Claims, 8 Drawing Sheets

(51) Int. Cl.

| | |
|---|---|
| ***B65D 51/20*** | (2006.01) |
| ***B65D 77/06*** | (2006.01) |
| ***B65D 47/20*** | (2006.01) |
| ***B67D 7/02*** | (2010.01) |
| ***B65D 51/18*** | (2006.01) |

(52) U.S. Cl.
CPC ..... *B65D 51/18* (2013.01); *B65D 51/20* (2013.01); *B65D 77/067* (2013.01); *B67D 7/0294* (2013.01); *B65D 2251/0031* (2013.01); *B65D 2251/0087* (2013.01)

(58) Field of Classification Search
CPC .... B65D 2251/0031; B65D 2251/0087; B65D 51/18; B67D 7/0294
USPC ..... 141/348, 351, 363; 215/265; 222/105, 222/531, 501, 559
See application file for complete search history.

(56) References Cited

U.S. PATENT DOCUMENTS

| | | | | |
|---|---|---|---|---|
| 4,421,146 | A | 12/1983 | Bond et al. | |
| 5,392,939 | A * | 2/1995 | Hidding | B67D 3/0032 141/348 |
| 5,647,416 | A * | 7/1997 | Desrosiers | B67D 3/00 141/18 |
| 5,697,410 | A * | 12/1997 | Rutter | F16L 37/32 137/614.04 |
| 5,816,298 | A | 10/1998 | Stricklin et al. | |
| 6,102,448 | A * | 8/2000 | Fixemer | F16L 37/113 277/626 |
| 6,644,519 | B2 * | 11/2003 | Last | B65D 47/283 141/351 |
| 8,172,102 | B2 * | 5/2012 | Hidding | B67D 3/0032 215/253 |
| 8,408,425 | B2 * | 4/2013 | Lien | A45F 3/20 222/105 |
| 2004/0112917 | A1 * | 6/2004 | Groesbeck | B67D 1/0021 222/105 |
| 2004/0238476 | A1 | 12/2004 | Morini | |
| 2007/0267100 | A1 * | 11/2007 | Spear | B65D 47/141 141/351 |
| 2008/0025145 | A1 | 1/2008 | Peszynski et al. | |
| 2011/0248054 | A1 * | 10/2011 | Darby | B65D 77/067 222/522 |
| 2015/0001261 | A1 * | 1/2015 | Johnson | B67D 3/045 222/525 |
| 2015/0158713 | A1 * | 6/2015 | Orita | F25D 31/002 222/105 |
| 2018/0035787 | A1 * | 2/2018 | Jaeger | A42B 3/0406 |

FOREIGN PATENT DOCUMENTS

| | | |
|---|---|---|
| DE | 102009023077 A1 | 12/2009 |
| WO | 032097475 | 11/2003 |
| WO | 2013/024611 | 2/2013 |

* cited by examiner

APPARATUS FOR CLOSING A FLUID CONTAINER

FIELD OF THE INVENTION

The subject matter relates generally to an apparatus used to close an opening of a fluid container.

BACKGROUND OF THE INVENTION

Caps are used to prevent fluid leakage from a container filled with fluid. For fluid containers that are dispensed through various dispense apparatuses, the caps are designed to enable drawing the fluid out of the fluid container while the fluid container is connected to a dispensing apparatus. Some caps reseal once the fluid container is disconnected from the dispensing apparatus to prevent spillage. Furthermore, the caps are used to prevent the fluid inside the fluid container from being contaminated with dirt or other substances that can reduce the fluid quality.

Known dispensing apparatuses rely on gravity to pump the fluid from the fluid container through the cooler to the faucet of the dispensing apparatus. Thus the fluid container must be connected to the top of the dispensing apparatus. Some fluid containers comprise a sealing component that is removed before the fluid container is connected to the dispensing apparatus. Some of these sealing apparatuses are removed when the fluid container is connected to the dispensing apparatus. When the sealing apparatus is removed by a rigid tube, the fluid container is placed on the top of the dispensing apparatus and the force of gravity pushes the fluid container down on the rigid tube. When the rigid tube comes in contact with the sealing component, the rigid tube pushes out or breaks the sealing element so that fluid may flow into the dispensing apparatus.

Some capping apparatuses, such as the commercially available cap of Scholle provide for a silicon cap attached to a retaining ring. The silicon cap is flexible and comprises an aperture via which a pin enters to allow passage of fluid via the silicon cap.

SUMMARY

It is an object of the subject matter to disclose a capping apparatus comprising: a top plate connected to a fluid container, said top plate comprises an apparatus opening through which fluid is dispersed from the fluid container; wherein the apparatus opening is defined by an opening wall; a rigid cork that is slide-ably moveable between a first state in which a cork is snapped into the apparatus opening and a second state where the cork is snapped out of the apparatus opening, wherein the cork moves between the first state and the second state horizontally when the fluid container is deployed in a fluid dispensing apparatus.

In some cases, the fluid is dispensed from the fluid container via the apparatus opening when the cork is in the second state.

In some cases, the a fluid dispensing tube of a fluid dispensing apparatus is inserted into the apparatus opening and snaps the cork from the first state to the second state.

In some cases, the capping apparatus is connected to a spout of the fluid container, wherein the spout is a fluid container opening from which the fluid is dispensed, said spout comprises a spout protrusion for fastening the capping apparatus onto the spout.

In some cases, the capping apparatus further comprises a first wall and a second wall extending from the top plate, wherein the spout is secured between the first wall and the second wall. In some cases, the first wall comprises a niche to enable fastening the capping apparatus onto the spout. In some cases, the capping apparatus is connected to a spout of the fluid container.

In some cases, the capping apparatus further comprises a seal to cover the apparatus opening to prevent contaminants from entering the apparatus opening.

In some cases, the apparatus opening has varying circumferences. In some cases, the fluid container is formed as a bag in a box.

In some cases, the cork comprises a cork capping rim of a radius wide enough to seal the apparatus opening and a cork rigid wall that is connected perpendicularly to the cork capping rim.

In some cases, the cork comprises a cork opening to receive a blunt pin connected to a fluid dispensing tube, said blunt pin is inserted into the cork opening to enable moving the cork when the fluid dispensing tube is moved by a user.

In some cases, the cork comprises one or more cork bumps on the cork rigid wall near the cork opening to prevent the cork from moving out of the apparatus opening; the one or more cork bumps attached to the cork rigid wall and the cork capping rim.

In some cases, the cork is returned to the first state when a fluid dispensing tube is removed from the apparatus opening, said cork is inserted into the apparatus opening.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are optionally designated by the same numerals or letters.

DETAILED DESCRIPTION

The subject matter relates generally to an apparatus used to close an opening of a fluid container, according to exemplary embodiments.

Figure 1A:
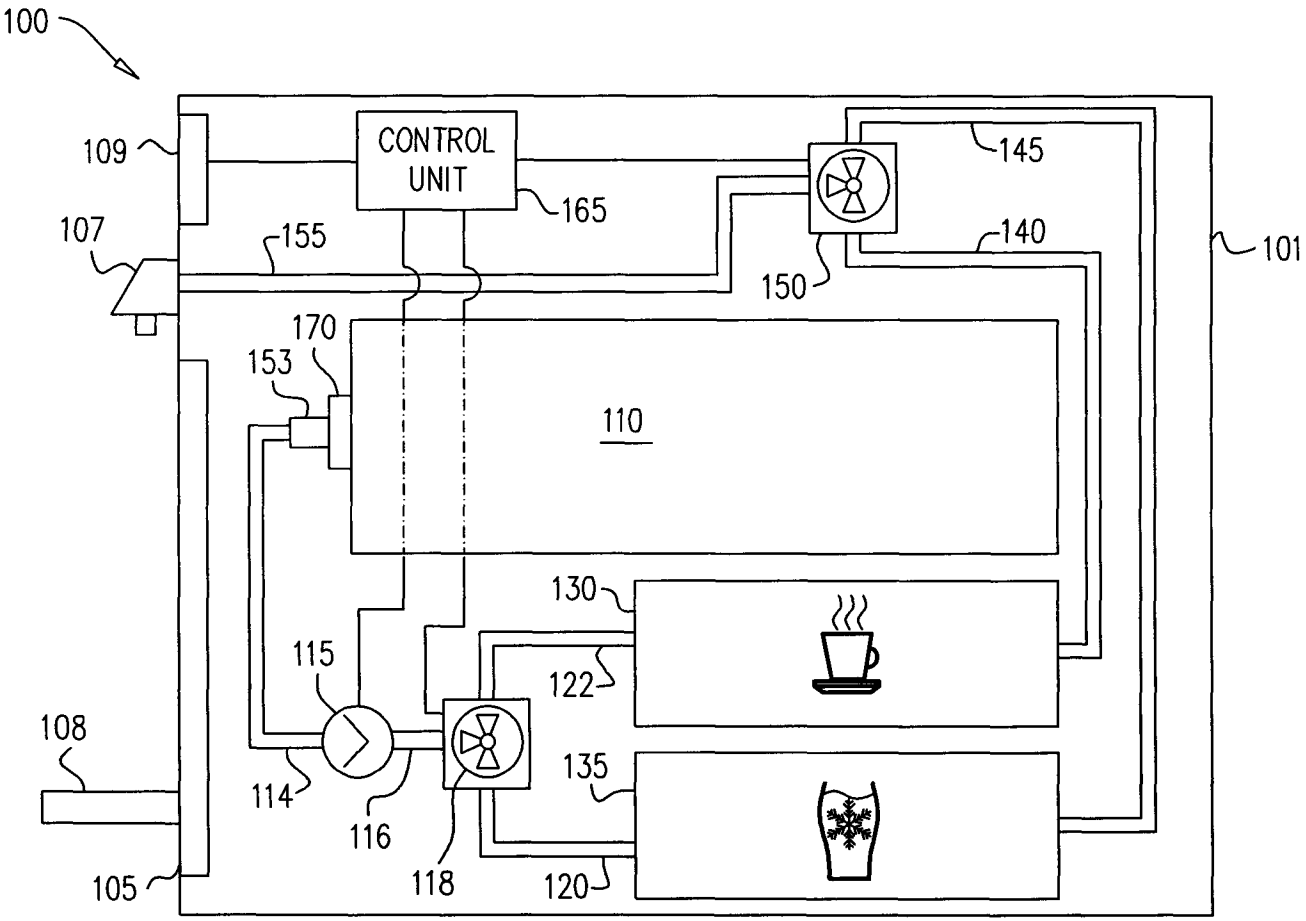
FIG. 1A shows a schematic representation of a fluid dispensing apparatus, according to some exemplary embodiments of the subject matter.

FIG. 1A shows a schematic representation of a fluid dispensing apparatus 100, according to some exemplary embodiments of the subject matter. In an exemplary embodiment of the subject matter, the fluid dispensing apparatus 100 may provide water, for example filtered water, mineral water, purified water, tap water and the like. Optionally, the fluid dispensing apparatus 100 may deal with other fluids (e.g. liquids or gases) such as oil, wine, juices, $CO_2$ and the like. The fluid dispensing apparatus 100 comprises a housing 101. The housing 101 is closed, such that the user cannot touch any element in the fluid dispensing apparatus 100 when an opening 105 (e.g. a door) of the fluid dispensing apparatus 100 is closed, and a hot fluid tank 130 and a cold fluid tank 135 are isolated from the temperature outside the fluid dispensing apparatus 100. In some cases, the fluid dispensing apparatus 100 does not exceed a height of seventy centimeters. The housing 101 stores a fluid container 110, such as a bag in box fluid container. The fluid container 110 stores between 6-12 liters, for example 8.5 liters. The fluid container 110 is located proximally to the opening 105, which enables quick and easy removal of the fluid container 110 from the fluid dispensing apparatus 100. The fluid container 110 is connected to a pump 115 by a fluid container pipe 114. The pump 115 is connected to an entering valve 118, by a pump pipe 116. The entering valve 118 allows fluid to flow to hot fluid tank 130 through a hot fluid entering pipe 122. A heating unit (not shown) heats fluid pumped into the hot fluid tank 130. The entering valve 118 further allows fluid to flow to cold fluid tank 135 through a cold fluid entering pipe 120. A chilling unit (not shown) chills fluid in the cold fluid tank 135. The hot fluid tank 130 and the cold fluid tank 135 are connected to an outlet valve 150 by a hot fluid exiting pipe 140 and a cold fluid exiting pipe 145 respectively. The outlet valve 150 is connected to a dispensing pipe 155, which enables the fluid to flow from the outlet valve 150 to an outlet 107. The outlet 107 dispenses fluid into a user provided container (not shown), which may be positioned on a tray 108 to receive fluid from the outlet 107 without requiring that the user hold the container while filling the container with fluid.

The fluid dispensing apparatus 100 may also comprise a receiving unit 109, which enables the user to select the temperature of the fluid and what type of container the user is filling with fluid. In some exemplary embodiments of the subject matter, the receiving unit 109 is a graphic user interface. The receiving unit 109 transmits a user command received by the receiving unit 109 to a control unit 165. In some exemplary embodiments of the subject matter, the control unit 165 may comprise a computerized module with a processor and memory to perform instructions provided by the control unit 165. The control unit 165 may send instructions to other elements in the fluid dispensing apparatus 100. For example, the control unit 165 may send a first instruction to the pump 115 to instruct it to pump fluid from the fluid container 110. The control unit 165 may also send a second instruction to the entering valve 118 that regulates fluid flow either to the hot fluid tank 130, the cold fluid tank 135, or both, according to a user request as received at the receiving unit 109. For example, when a user presses on a hot fluid button on the receiving unit 109, the control unit 165 sends a first instruction to the pump 115 to pump fluid from the fluid container 110 and a second instruction to the entering valve 118 for the pumped fluid to flow to the hot fluid tank 130. The hot fluid tank 130 is always kept full. Hence, when fluid is pumped into the hot fluid tank 130, hot fluid is output from the hot fluid tank 130 via the outlet valve 150 to the user's container.

The control unit 165 sends a third instruction to the outlet valve 150 to dispense fluid from the hot fluid tank 130 or from the cold fluid tank 135. In some exemplary cases, the fluid is dispensed at room temperature. The outlet valve 150 dispenses fluid from the hot fluid tank 130 and the cold fluid tank 135 in alternating time bursts so that the hot and cold fluid mix and the fluid dispensed to the container is at room temperature: for example, an alternating burst every 10 milliseconds. In accordance with some exemplary cases, the alternating burst may be of various speeds to create fluid of different temperatures. For example, the user requests fluid that is warm, the bursts of fluid pumped from the hot fluid tank 130 are longer than the bursts of fluid pumped from the cold fluid tank 135. All pipes and fluid tanks comprising the fluid dispensing apparatus 100 are filled with fluid, which enables the rapid dispensing of fluid and to have a small fluid container. The alternating bursts of fluid from the hot fluid tank 130 and the cold fluid tank 135 enables regulation of fluid temperature without a mixing container as known in prior art devices. Lack of said mixing container reduces the volume consumed by fluid dispensing apparatus 100 of the disclosed subject matter.

The fluid container pipe 114 is inserted into an opening of a capping apparatus 170. The capping apparatus 170 comprises a cork (not shown), which seals the capping apparatus 170 when the fluid container pipe 114 is not inserted into the apparatus opening. In some non-limiting cases, the cork is a rigid cork. The capping apparatus 170 is deployed horizontally with the fluid container 110. The capping apparatus 170 is connected to fluid container 110, such as a bag in the box container. The fluid container pipe 114 comprises a blunt pin 153 which is manually inserted into the capping apparatus 170.

Figure 1B:
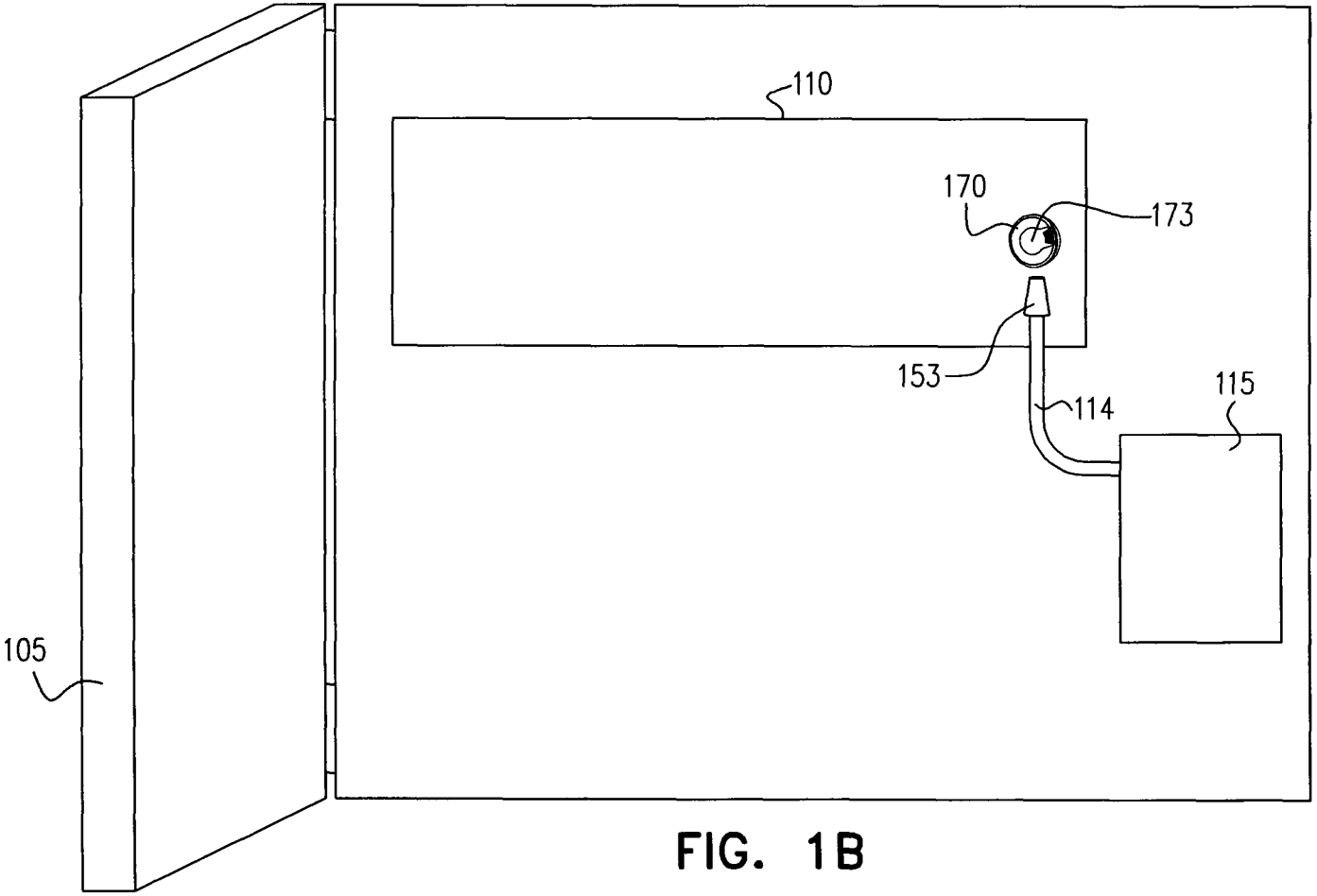
FIG. 1B shows a fluid dispensing apparatus with a fluid container, according to some exemplary embodiments of the subject matter.

FIG. 1B shows a front view of fluid dispensing apparatus 100 with a fluid container 110, according to some exemplary embodiments of the subject matter. The fluid container pipe 114 comprises blunt pin 153 connected to the end of the fluid container pipe 114. The fluid container pipe 114 is moved by a user of the fluid dispensing apparatus 100 horizontally towards the capping apparatus 170 when inserted into the capping apparatus 170. The blunt pin 153 moves the cork 173 horizontally to push the cork 173 inward from the apparatus opening to allow the fluid container pipe 114 to enter the fluid container 110. The blunt pin 153 is designed to snap into a cork opening displacing the cork 173 from blocking the opening while grasping it to prevent the cork 173 from falling into the fluid container 110. The fluid is pumped from the fluid container 110 to the outlet 107 from which fluid is dispensed to a user receptacle (not shown), such as a bottle, glass, or the like. In some exemplary cases, the fluid dispensing apparatus 100 comprises a tray 108 for positioning glasses or bottles when dispensing fluid into the bottles or glasses. The user receptacles are placed on the tray 108 when fluid is dispensed from the outlet 107. The tray 108 is positioned below the outlet 107. The tray 108 may include one or more openings through which fluid can be collected in the tray 108 if spilled from the receptacle or the outlet 107.

Figure 2:
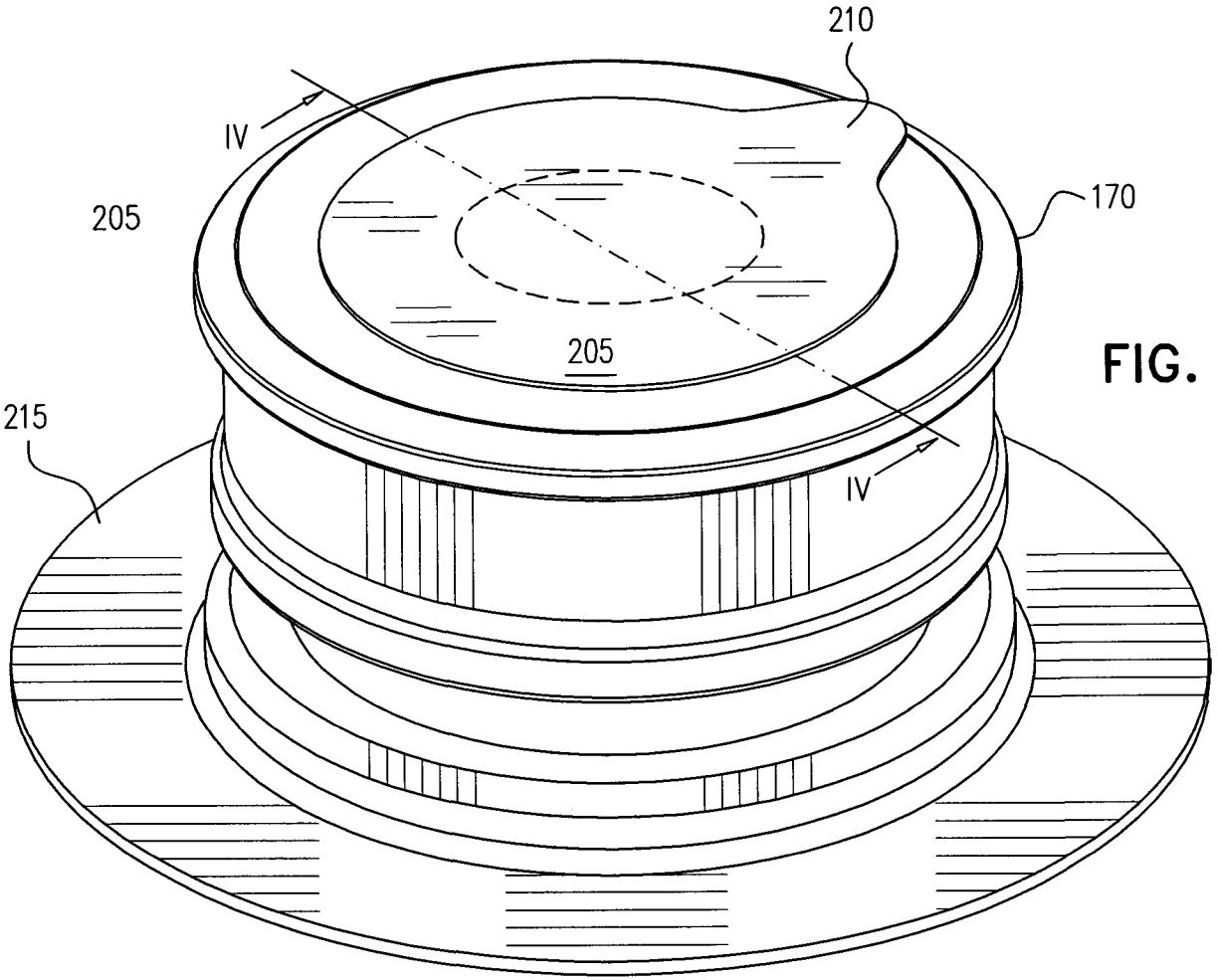
FIG. 2 show a capping apparatus connected to a fluid container, according to some exemplary embodiments of the subject matter.

FIG. 2 shows capping apparatus 170 connected to a fluid container 110, according to some exemplary embodiments of the subject matter. The capping apparatus 170 is connected to a spout 215 that serves as an opening of the fluid container 110 of FIG. 1. In some exemplary embodiments of the subject matter, the capping apparatus 170 is removable from the spout 215 such that the capping apparatus 170 may be connected to a different type of a fluid container for use with the fluid dispensing apparatus 100 of FIG. 1. The capping apparatus 170 is attached to the spout 215 by pushing and/or turning it to click on to the spout 215. For example the attachment may be performed by pressing the body of the capping apparatus 170 onto the spout 215. In some cases the capping apparatus 170 comprises a protective seal 205, which prevents dust from entering an opening 306 (see FIG. 3) of the capping apparatus 170 below protective seal 205. The protective seal 205 is removed from the capping apparatus 170 by a user replacing the fluid container 110 prior to connecting the fluid container 110 to the fluid dispensing apparatus 100. Optionally, the fluid container 110 is relatively small, for example in the range of 5-10 liters, to fit into a compact fluid dispensing apparatus 100 that is designed for example to be mounted on a kitchen counter. In an exemplary embodiment of the disclosure, the spout 215 and the capping apparatus 170 attached to the spout 215 are small as well. For example, the capping apparatus 170 may have a diameter of about 4 centimeters and a height of about 1.5 centimeters.

Figure 3E:
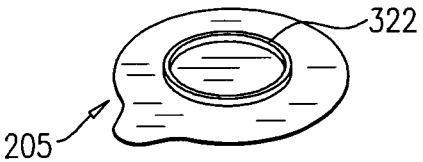
FIGS. 3A-3H show three dimensional embodiments of components of a capping apparatus, according to some exemplary embodiments of the subject matter.
Figure 3F:
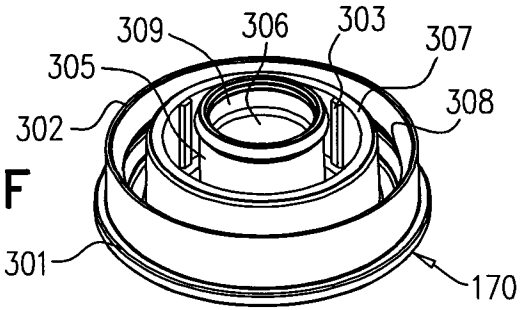
Figure 3G:
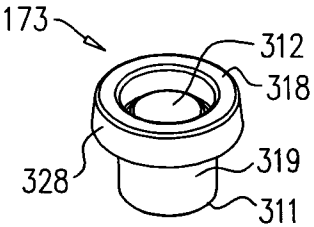
Figure 3H:
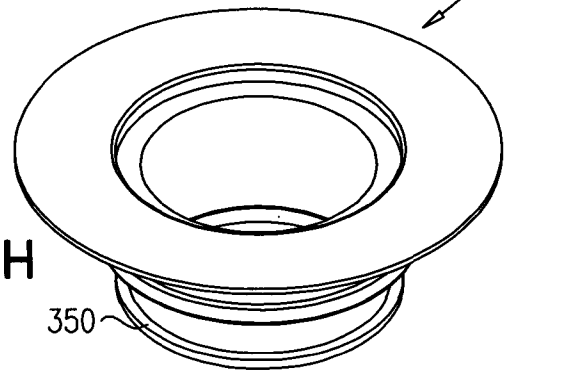
Figure 3A:
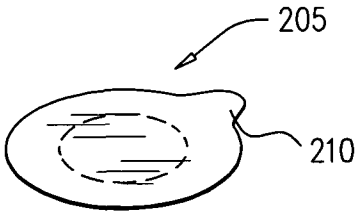

FIG. 3A-3H show three dimensional embodiments of components of capping apparatus 170 and spout 215, according to some exemplary embodiments of the subject matter. FIGS. 3A to 3D show the elements deployed upward and FIGS. 3E to 3H show the same elements respectively flipped over. FIGS. 3A and 3E show protective seal 205 of capping apparatus 170, which is disclosed in detail in FIGS. 3B and 3F, according to some exemplary embodiments of the subject matter. The protective seal 205 comprises a flap 210, which enables a user to remove the protective seal 205 off the capping apparatus 170 before inserting the fluid container pipe 114 of FIG. 1 through the capping apparatus 170. The protective seal 205 is used to cover the capping apparatus 170 until the fluid container pipe 114 needs to be inserted into the capping apparatus 170.

As shown in FIG. 3E, the protective seal 205 comprises a seal cylindrical wall 322, which is molded as part of the protective seal 205 to be inserted into opening 306 and hold protective seal 205 in place.

Figure 3B:
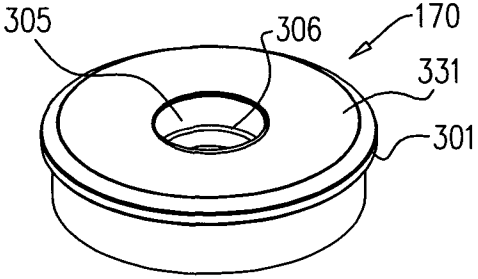

FIG. 3B and FIG. 3F show capping apparatus 170, according to some exemplary embodiments of the subject matter. The capping apparatus 170 is connected to an opening of the fluid container 110 of FIG. 1 to the spout 215 shown in FIGS. 3D, 3H. The capping apparatus 170 comprises a top plate 331, which covers the opening of the fluid container 110. The top plate 331 comprises an apparatus opening 306, which enables insertion of the fluid container pipe 114 to draw fluid from the fluid container 110. The apparatus opening 306 may comprise an opening wall 305 of varying circumferences. For example, the opening wall 305 may be tapered comprises a narrower circumference near the top plate 331 and a wider circumference at an opposite end of the opening wall 305.

In some exemplary embodiments of the subject matter, the capping apparatus 170 comprises a first wall 302 located adjacent to a rim 301 of the top plate 331, extending perpendicularly from the top plate 331. For example, the first wall 302 is located 1 millimeter from the rim 301 towards the center of the top plate 331. The first wall 302 comprises a niche 308 which enables to fasten the capping apparatus 170 onto the spout 215 of the fluid container 110. The capping apparatus 170 may further comprise a second wall 307 connected to the top plate 331. The second wall 307 is located closer to the apparatus opening 306 than the first wall 302. The second wall 307 comprises teeth 303 which create support for the second wall 307. The second wall 307 provides support to enable a more secure attachment to the spout 215. In some exemplary cases, the spout 215 is configured to be secured between the first wall 302 and the second wall 307.

Figure 3C:
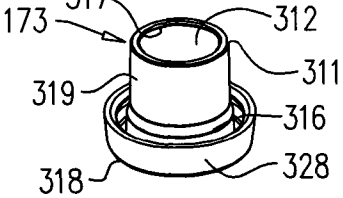

FIG. 3C and FIG. 3G show cork 173, according to some exemplary embodiment of the subject matter. The cork 173 comprises a cork capping rim 318, which seals the apparatus opening 306 when the cork 173 is inserted into the apparatus opening 306. The cork 173 is slide-ably moveable in or out of the apparatus opening 306. Optionally, the cork 173 may be tapered and/or have a varying circumference to match the varying circumference of the opening wall 305. In some cases, the cork 173 may be inserted in a slope of up to about 15 degrees from the horizon. In some exemplary cases, the cork 173 is made of a plastic material, or from another rigid material that enables the cork 173 to slide in and out of the apparatus opening 306. The cork capping rim 318 comprises a radius wide enough to cover and seal the apparatus opening 306 such that fluid does not flow through the apparatus opening 306 while the cork 173 is inserted therein. The cork 173 comprises a cork rigid wall 319, which is snapped in or out of the apparatus opening 306. The cork rigid wall 319 is perpendicular to the top of cork 173, namely capping rim 318 and extends from the cork capping rim 318 to a second rim 311 on the top of cork 173.

The cork 173 comprises a cork opening 312, which enables insertion of a blunt pin (153 in FIG. 1B) into the cork 173. When the blunt pin 153 is inserted into the cork opening 312, the cork 173 attaches itself to blunt pin 153 and is moved with blunt pin 153 by manipulation of the fluid container pipe 114 of FIG. 1. The blunt pin 153 is inserted into the cork opening 312 in a horizontal direction, when the fluid container pipe 114 is inserted into the apparatus opening 306. The cork rigid wall 319 comprises one or more cork bumps 317 facing inward beneath the second rim 311. The one or more cork bumps 317 cause the cork 173 to attach itself to the blunt pin 153 when it is inserted into opening 306 (as shown later in FIG. 5). This allows the cork to be pulled back into opening 306 when removing blunt pin 153 and fluid container 114 from opening 306. The cork 173 comprises a cork spiral 316 located on the cork rigid wall 319 in the area of the cork capping rim 318. The cork spiral 316 provides further friction to prevent the cork 173 from falling out of the apparatus opening 306. Additionally the cork capping rim 318 includes side walls 328 to cap the bottom of opening wall 305 surrounding opening 306.

Figure 3D:
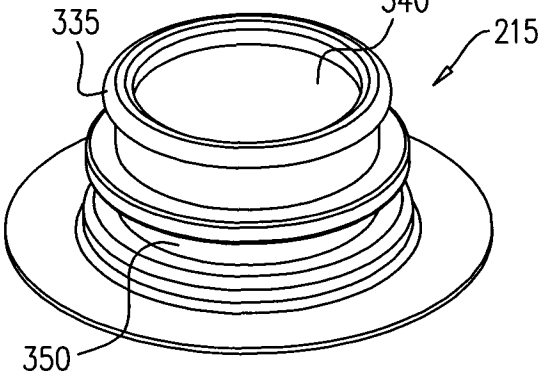

FIG. 3D and FIG. 3H shows the spout 215, according to some exemplary embodiments of the subject matter. The spout 215 is an opening of the fluid container 110 through which fluid may be dispensed from the fluid container 10 to the fluid dispensing apparatus 100. The capping apparatus 170 is used to cover spout 215. The spout 215 comprises a spout opening 340 through which fluid is removed from the fluid container 110. The spout 215 comprises a spout wall 350. The spout wall 350 comprises a spout protrusion 335, which enables fastening the capping apparatus 170 to the spout 215. The capping apparatus 170 is connected by fastening the capping apparatus 170 onto the spout 215 such that the niche 308 interlocks with the spout protrusion 335. The second wall 307 of the capping apparatus 170 ensures that when the capping apparatus 170 is fastened onto the spout 215, the spout wall 350 is tightly held up against the first wall 302.

Figure 4:
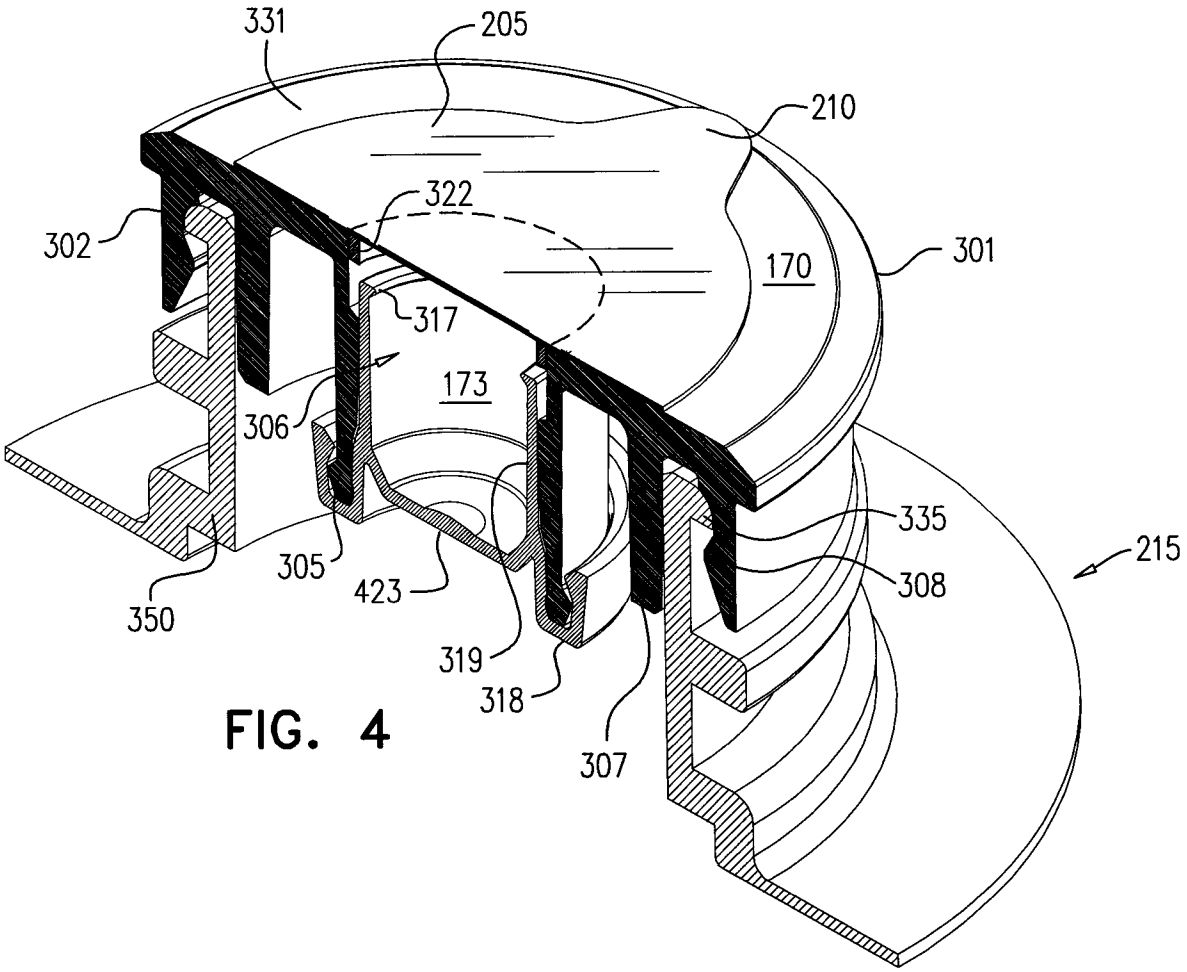
FIG. 4 shows a capping apparatus with a cork connected to a fluid container, according to some exemplary embodiments of the subject matter; and, FIG. 5 shows a capping apparatus when a fluid container is deployed in a fluid dispensing apparatus, according to some exemplary embodiments of the subject matter.

FIG. 4 shows a cross sectional view of capping apparatus 170 with a cork 173 connected to a fluid container 110, according to some exemplary embodiments of the subject matter. FIG. 4 shows capping apparatus 170 in a first state, for example as fluid container 110 is initially provided, wherein the fluid container is capped and sealed with capping apparatus 170 and cork 173 sealing spout opening 340 of spout 215. As explained previously and shown in FIG. 4 capping apparatus 170 is connected to the fluid container 110 of FIG. 1 by connecting to a spout 215, which forms a fluid dispensing opening 340 located on a fluid container wall of the fluid container 110. The spout 215 comprises spout wall 350, which comprises spout protrusion 335. The spout protrusion 335 enables fastening the spout 215 with capping apparatus 170, or other elements that may be fastened onto the spout 215. The spout wall 335 is cylindrically shaped, so that the spout 215 is round, which enables an even flow of fluid out of the spout 215. As explained above regarding FIG. 3 capping apparatus 170 comprises first wall 302 which comprises niche 308 on an internal side of the first wall 302. The niche 308 fastens the spout protrusion 335 to secure the capping apparatus 170 onto the spout 215.

The capping apparatus 170 comprises cork 173 inserted therein, which in the first state is in opening 306 of the capping apparatus 170. The cork 173 comprises circular capping rim 318 with side wall 328, which extends over the circumference of cylindrical wall 319 of the cork 173. The circular capping rim 318 rests against the capping apparatus third wall 305 so the capping apparatus opening 306 is sealed while the cork 173 is inserted into the apparatus opening 306. The cork 173 comprises a circular base 423, which seals the cork 173 to prevent fluid from passing through the cork 173. The cork 173 comprises cylindrical wall 319, which presses against capping apparatus third wall 305. The cylindrical wall 319 comprises a circumference that enables the cork 173 to be securely fitted into the apparatus opening 306. The capping apparatus 170 may have seal 205 attached to protect the apparatus opening 306 from accumulation of contaminants, such as dust. The seal 205 comprises flap 210, which enables a user to easily remove the seal 205 prior to insertion of the fluid container 110 into the fluid dispensing apparatus 100. The seal 205 is removed by pulling the seal 205 away from the capping apparatus 170 until the apparatus opening 306 is accessible to the fluid dispensing tube 114.

Figure 5:
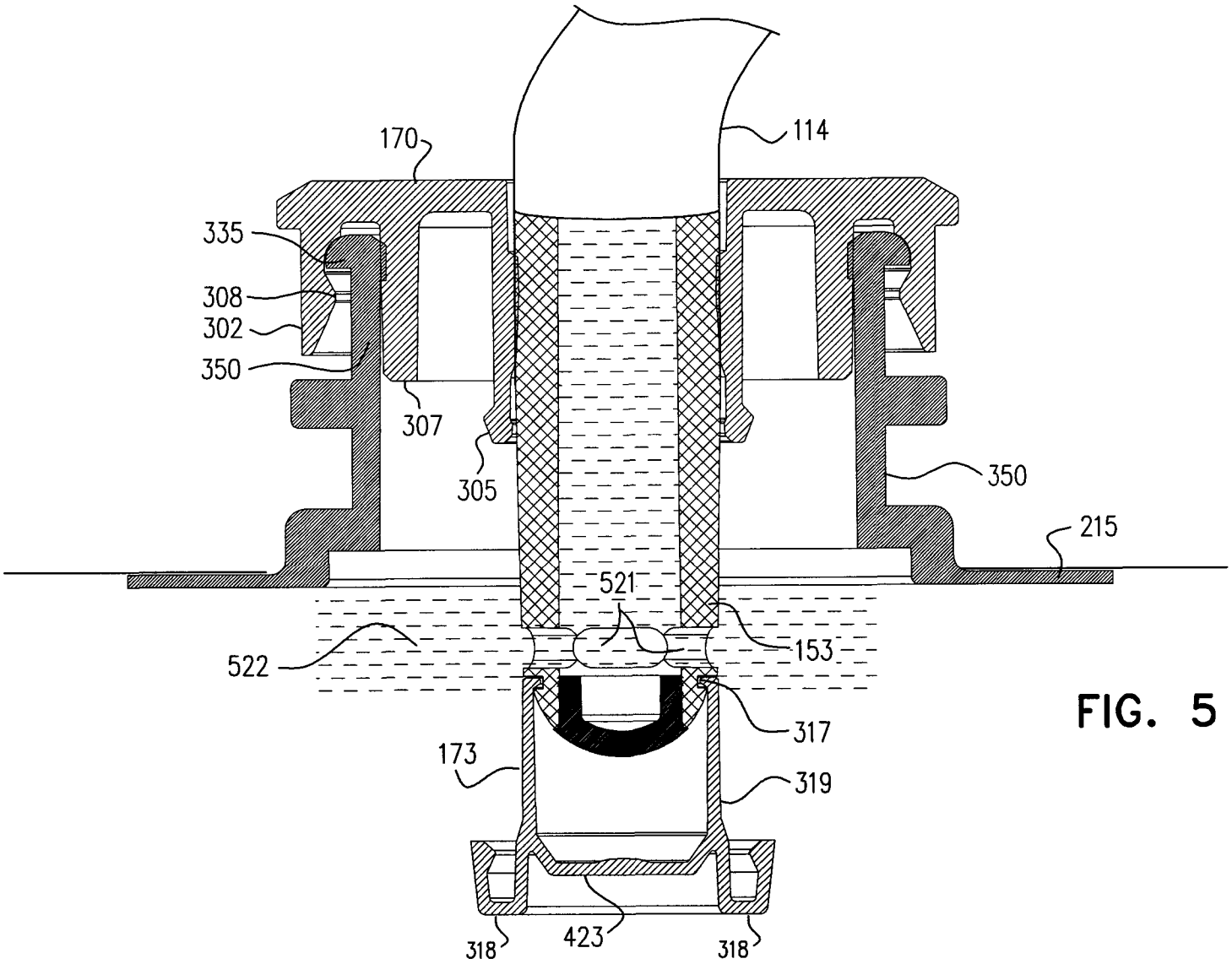

FIG. 5 shows a cross sectional view of capping apparatus 170 when a fluid container 110 is connected to a fluid dispensing apparatus 100, according to some exemplary embodiments of the subject matter. FIG. 5 shows capping apparatus 170 in a second state, after inserting blunt pin 153, so that cork 173 is attached to blunt pin 153 and displaced into fluid container 110 to allow fluid to flow from fluid container 110 through fluid container pipe 114. The capping apparatus 170 is connected to spout 215 of the fluid container 110. When the fluid container 110 is deployed in a fluid dispensing apparatus 100, fluid container pipe 114 with blunt pin 153 connected to its end is inserted into apparatus opening 306 of the capping apparatus 170. As the fluid container pipe 114 is inserted through the apparatus opening, blunt pin 153 connects to cork 173 by way of bumps 317. The blunt pin 153 snaps the cork 510 out of the capping apparatus 170 into the second state in which the cork 173 is out of the apparatus opening 306. The fluid container pipe 114 or blunt pin 153 comprise fluid tube holes 521 located on a portion of the fluid container pipe 114 or blunt pin 153 that is inserted into the spout 215. Fluid 522 exits the fluid container 110 through the fluid tube holes 521 so that fluid 522 may be dispensed by the fluid dispensing apparatus 100. When the fluid container 110 is being replaced, the fluid container 110 is detached from the fluid dispensing apparatus such that the fluid container pipe 114 with blunt pin 153 slides out of the capping apparatus 170. As the fluid container pipe 114 slides out of the capping apparatus 170 the blunt pin 153 is snapped back from the apparatus opening, returning the cork 510 to the first state. Then the blunt pin 153 disconnects from cork 173. The cork 173 seals the capping apparatus 170 so that fluid container 110 may be removed from the fluid dispensing apparatus 100 without any leftover fluid spilling out of the fluid container 110.

Apparatus niche 308 interlocks with the spout protrusion 335 when the cork 173 is inside the apparatus opening 306. Spout wall 350 defines the external shape of the spout 215.

The cork 173 comprises a cork capping rim 318 located on one end of the cork 173, relatively adjacent to a cork base 423 on which the blunt pin 153 rests when pushing the cork 173 out of the capping apparatus opening 306. In some cases, the fluid container 110 still contains fluid 522 when the fluid container 110 is removed from the fluid dispensing apparatus 100. In such a case, the cork 173 prevents spillage of the fluid remaining within the fluid container 110 during its removal from the fluid dispensing apparatus 100 and during carrying of the fluid container 110. For example, even though the capping apparatus 170 is horizontally connected to the fluid container 110 and the fluid container 110 removed is half full of fluid, the fluid will not spill out of the fluid container 110 because the cork 173 is firmly located inside the apparatus opening 306.

Figure 6:
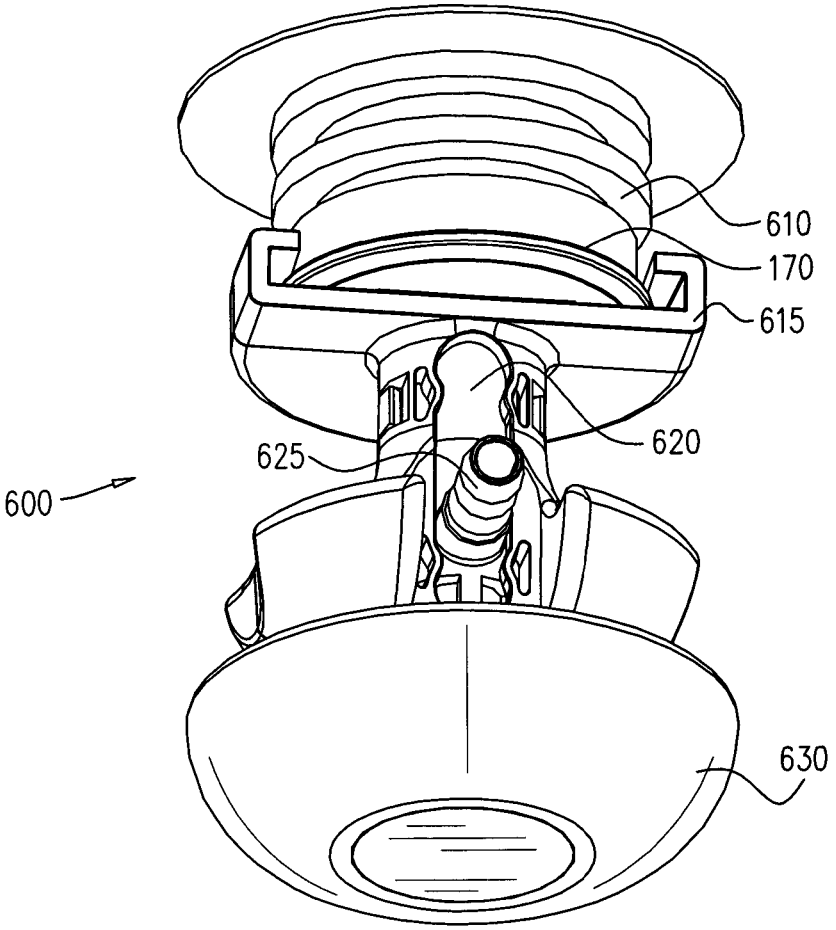
FIG. 6 shows a mechanism for using and manipulating the capping apparatus, according to some exemplary embodiments of the subject matter.

FIG. 6 shows a mechanism 600 for using and manipulating capping apparatus 170, according to some exemplary embodiments of the subject matter. The mechanism 600 comprises a handle 630 for pressing an alternative blunt pin 620 which drives the cork 173 into apparatus opening 306. The handle 630 is connected to capping apparatus 170 that is positioned on top of a spout 215. In an exemplary embodiment of the subject matter an aperture 625 through which fluid exits the fluid container 110 extends from the blunt pin 153.

Figure 7:
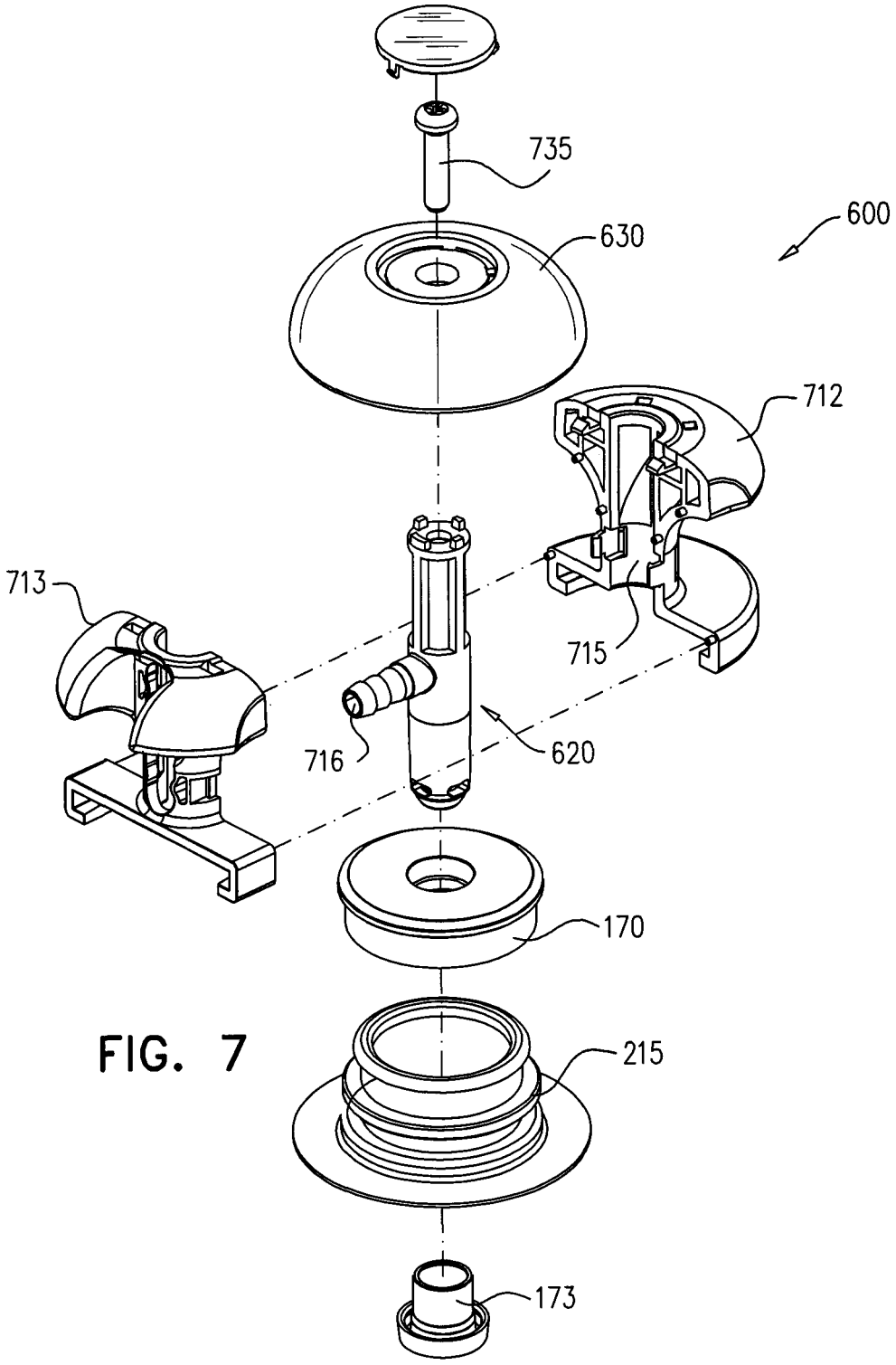
FIG. 7 shows an exploded view of the mechanism for using and manipulating the capping apparatus, according to some exemplary embodiments of the subject matter.

FIG. 7 shows an exploded view of mechanism 600 for using and manipulating capping apparatus 170, according to some exemplary embodiments of the subject matter. The figure shows a cork 173, a spout 215 and a capping apparatus 170. The mechanism 600 for using and manipulating the capping apparatus 170, shown in an exploded view of two halves 712, 713, comprises a mechanism opening 715 through which the alternative blunt pin 620 moves to push the cork 173 out of the apparatus opening 306. In some embodiments of the subject matter, a fluid aperture 716, extending from the blunt pin 620, enables fluid to exit from the fluid container 110 to fluid container pipe 114. A handle 630 is attached to the top of the blunt pin 620. A connector 735 is inserted between the handle 630 and the blunt pin 620, which connects the handle 630 to the blunt pin 620.

While the disclosure has been described with reference to exemplary embodiments, it will be understood by those skilled in the art that various changes may be made and equivalents may be substituted for elements thereof without departing from the scope of the subject matter. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this subject matter, but only by the claims that follow.

The invention claimed is:

1. A system for using and manipulating a capping apparatus for a fluid container comprising:

a top plate sealably connectable to a spout of the fluid container, said top plate comprises an apparatus opening through which fluid is dispensed from the fluid container;

wherein the apparatus opening is defined by an opening wall extending inward toward the fluid container from the top plate;

a rigid cork that is slide-ably moveable between a first state in which the cork is positioned inside the apparatus opening blocking fluid flow and a second state where the cork is snapped out of the apparatus opening into the fluid container to allow fluid flow; and a blunt pin connected to a handle, said handle configured for pressing onto the blunt pin such that the cork moves between the first state and the second state by being designed to attach the cork to the blunt pin that is inserted into the apparatus opening, by said handle to push the cork from the first state to the second state and to be pulled back by the blunt pin into the first state when removing the blunt pin, wherein said blunt pin is configured to receive two halves of a mechanism for using and manipulating the capping apparatus, wherein said two halves connect the blunt pin to the handle.

2. The system of claim 1, wherein the fluid is dispensed from the fluid container via the apparatus opening when the cork is in the second state.

3. The system of claim 1, wherein a fluid dispensing tube of a fluid dispensing apparatus is connected to the blunt pin that is inserted into the apparatus opening to transfer the cork from the first state to the second state.

4. The system of claim 1, wherein the capping apparatus is connected to the spout of the fluid container, wherein the spout is a fluid container opening from which the fluid is dispensed, said spout comprises a spout protrusion for fastening the capping apparatus onto the spout.

5. The system of claim 4, further comprises:

a first wall and a second wall extending from the top plate, wherein the spout is secured between the first wall and the second wall.

6. The system of claim 5, wherein the first wall comprises a niche to enable fastening the capping apparatus onto the spout.

7. The system of claim 1, wherein the capping apparatus is connected to the spout of the fluid container.

8. The system of claim 1, further comprising a seal to cover the apparatus opening to prevent contaminants from entering the apparatus opening.

9. The system of claim 1, wherein the apparatus opening has varying circumferences.

10. The system of claim 1, wherein the fluid container is formed as a bag in a box.

11. The system of claim 1, wherein the cork comprises:

a cork capping rim of a radius wide enough to seal the apparatus opening;

a cork rigid wall that is connected perpendicularly to the cork capping rim.

12. The system of claim 11, wherein the cork comprises:

a cork opening to receive the blunt pin that is connected to a fluid dispensing tube, said blunt pin is inserted into the cork opening to enable moving the cork when the fluid dispensing, tube is moved by a user.

13. The system of claim 12, wherein the cork comprises:

one or more cork bumps on the cork rigid wall near the cork opening to prevent the cork from moving out, of the apparatus opening;

the one or more cork bumps attached to the cork rigid wall and the cork capping rim.

14. The system of claim 1, wherein the cork is returned to the first state when a fluid dispensing tube is removed from the apparatus opening, said cork is inserted into the apparatus opening.

15. The system of claim 1, wherein said handle is connected to the blunt pin by a connector, which is inserted between the handle and the blunt pin.

16. The system of claim 1, wherein said two halves secure the capping apparatus to the handle.

17. The system of claim 1, wherein the handle is at least as wide as the spout.

18. The system of claim 1, wherein said blunt pin comprises a fluid passage that conjoins with the opening wall of the apparatus opening through which fluid is dispensed, and further wherein said blunt pin comprises a fluid aperture to enable fluid to exit from the fluid container, said fluid aperture extending perpendicularly from the blunt pin, thereby creating an L shape between the fluid inlet at the opening wall and the fluid outlet at the fluid aperture.

* * * * *